US008260160B2

(12) United States Patent
Akashi et al.

(10) Patent No.: US 8,260,160 B2
(45) Date of Patent: Sep. 4, 2012

(54) COLOR IMAGE FORMING APPARATUS

(75) Inventors: Hironori Akashi, Okazaki (JP); Soh Hirota, Toyokawa (JP); Mitsuru Obara, Toyohashi (JP); Takashi Harashima, Sagamihara (JP); Kanako Kibihara, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 227 days.

(21) Appl. No.: 12/842,514

(22) Filed: Jul. 23, 2010

(65) Prior Publication Data

US 2011/0044705 A1 Feb. 24, 2011

(30) Foreign Application Priority Data

Jul. 25, 2009 (JP) ..... 2009-173771

(51) Int. Cl.
*G03G 15/08* (2006.01)
*G03G 15/00* (2006.01)

(52) U.S. Cl. ..... 399/27; 399/49; 399/55

(58) Field of Classification Search ..... 399/27, 399/49, 55

See application file for complete search history.

(56) References Cited

U.S. PATENT DOCUMENTS

| | | | | |
|---|---|---|---|---|
| 5,737,665 | A | 4/1998 | Sugiyama et al. | |
| 6,415,114 | B1 * | 7/2002 | Nakazato et al. | 399/49 |
| 6,650,849 | B2 * | 11/2003 | Shimura | 399/49 |
| 7,031,625 | B2 | 4/2006 | Ebe | |
| 7,881,629 | B2 | 2/2011 | Takeuchi et al. | |
| 2008/0112715 | A1 | 5/2008 | Shiroki et al. | |

FOREIGN PATENT DOCUMENTS

| | | |
|---|---|---|
| JP | 63-058472 | 3/1988 |
| JP | 04-329562 | 11/1992 |
| JP | 06-214451 | 8/1994 |

(Continued)

OTHER PUBLICATIONS

Office Action (Notification of Reasons for Refusal) dated Apr. 12, 2011, issued in the corresponding Japanese Patent Application No. 2009-173771, and an English Translation thereof.

*Primary Examiner* — Hoang Ngo
(74) *Attorney, Agent, or Firm* — Buchanan Ingersoll & Rooney PC

(57) ABSTRACT

A color image forming apparatus having photosensitive members; developing devices for developing electrostatic latent images formed on the photosensitive members into toner images with developers comprising toner and carriers; toner concentration sensors for detecting toner concentrations of the developers in the respective developing devices; a toner image bearing member for bearing the toner images temporarily; a toner adherence amount sensor for detecting toner adherence amounts of the toner images held on the image bearing member; and a controller for calculating, with respect to the developing devices, individual optimal developing bias voltage ranges within which a target toner adherence amount can be achieved while the toner concentrations of the developers are within a predetermined toner concentration range from a lower limit to an upper limit, so as to specify a common optimal developing bias voltage range that are commonly suitable for all the developing devices to achieve the target toner adherence amount while the toner concentrations of the developers in the developing devices are within the predetermined toner concentration range, and for calculating target toner concentrations of the developers in the respective developing devices to achieve the target toner adherence amount while a voltage within the common optimal developing bias voltage range is applied between each of the photosensitive members and each of the developing devices.

12 Claims, 5 Drawing Sheets

FOREIGN PATENT DOCUMENTS

| | | |
|---|---|---|
| JP | 08-160696 | 6/1996 |
| JP | 11-015242 | 1/1999 |
| JP | 11-265132 | 9/1999 |
| JP | 2001-147580 A | 5/2001 |
| JP | 2002-040725 | 2/2002 |
| JP | 2002-162801 | 6/2002 |
| JP | 2004-354622 | 12/2004 |
| JP | 2006-017918 | 1/2006 |
| JP | 2008-046423 | 2/2008 |
| JP | 2008-107696 | 5/2008 |
| JP | 2008-181065 | 8/2008 |
| JP | 2009-086297 | 4/2009 |

* cited by examiner

COLOR IMAGE FORMING APPARATUS

This application is based on Japanese Patent Application No. 2009-173771 filed on Jul. 25, 2009, of which content is incorporated herein by reference.

BACKGROUND OF THE INVENTION

1. Field of the Invention

The present invention relates to a color image forming apparatus, and more particularly to a color image forming apparatus that finally transfers and fixes a toner image onto a recording sheet by an electrophotographic method.

2. Description of Related Art

In an electrophotographic color image forming apparatus that performs binary component developments by use of developers, each composed of toner and carriers, conventionally, the charge amount of toner depends on the color of the toner, that is, depends on whether the toner is Y (yellow), M (magenta), C (cyan) or K (black), and also depends on the toner concentration of the developer. Therefore, in order to achieve a target toner adherence amount of the colors on a toner image bearing member, such as a photosensitive drum or an intermediate transfer belt, either of the following methods is conventionally carried out; 1) a method wherein while the toner concentrations of the respective colors are fixed to a specified value, developing bias voltages for developments of the colors are adjusted; and 2) a method wherein while developing bias voltages for developments of the respective colors are fixed to a specified value, the toner concentrations of the colors are adjusted.

In the method 1), since the toner concentrations of the colors are set to a specified value, the toner concentrations never become out of a predetermined range from a lower limit and an upper limit, and trouble such as smudge and carrier consumption can be avoided. However, in the method 1), different developing bias voltages must be applied for developments of different colors. Accordingly, when the color image forming apparatus is of a tandem type that transfers toner images from four juxtaposed photosensitive drums one after another onto an intermediate transfer belt (first transfer) to combine the four color images into a full-color image, first transfer voltages for the first transfers of the respective colors must be set separately from one another because the toner concentrations of the colors are different from each other. Further, when the first transfer voltage to be applied to a photosensitive drum disposed downstream with respect to a moving direction of the intermediate transfer belt must be set higher than the first transfer voltage to be applied to a photosensitive drum disposed upstream, the amount of reversely transferred toner increases due to the higher transfer voltage at the downstream transfer point, and toner consumption and toner waste unnecessarily increases. Moreover, in performing second transfer from the intermediate transfer belt to a recording sheet, the optimal transfer conditions are different from color to color, and it is impossible to set an optimal second transfer voltage for all the four colors.

In the method 2), as described in Japanese Patent Laid-Open Publication No. 2001-147580, while the developing bias voltages for developments of the respective colors are fixed to a specified value, the toner concentrations are adjusted so as to achieve a target toner adherence amount. Therefore, it is possible to set the developing bias voltages for developments of the respective colors to the same value. In the method 2), however, because the toner concentrations of the colors are different, it is difficult to determine an optimal developing bias voltage common to all the colors beforehand.

Further, if it is found out that the toner concentration of a color must be set to a value out of the predetermined range to achieve the target toner adherence amount, the target toner adherence amount or the target development potential must be changed. More specifically, if it is found out that the toner concentration must be set less than the lower limit, the target toner adherence amount shall be changed to a higher value. If it is found out that the toner concentration must be set beyond the upper limit, the target development potential shall be raised. When the developing bias voltages for all the colors are set to the same value, naturally, it often occurs that the toner concentration for any of the colors must be set out of the predetermined range.

SUMMARY OF THE INVENTION

According to a first aspect of the present invention, a color image forming apparatus comprising: photosensitive members; chargers for charging surfaces of the respective photosensitive members; an exposure device for forming electrostatic latent images on the surfaces of the photosensitive members charged by the chargers; developing devices for developing the respective electrostatic latent images into toner images with developers comprising toner and carriers; toner concentration sensors for detecting toner concentrations of the developers in the respective developing devices; a voltage applying section for applying a developing bias voltage between each of the photosensitive members and each of the developing devices; a toner image bearing member for bearing toner images formed by the developing devices temporarily; a toner adherence amount sensor for detecting toner adherence amounts of the toner images held on the image bearing member; and a controller for calculating, with respect to the developing devices, individual optimal developing bias voltage ranges within which a target toner adherence amount can be achieved while the toner concentrations of the developers are within a predetermined toner concentration range from a lower limit to an upper limit, so as to specify a common optimal developing bias voltage range that are commonly suitable for all the developing devices to achieve the target toner adherence amount while the toner concentrations of the developers in the developing devices are within the predetermined toner concentration range, and for calculating individual target toner concentrations of the developers in the respective developing devices to achieve the target toner adherence amount while a voltage within the common optimal developing bias voltage range is applied between each of the photosensitive members and each of the developing devices.

According to a second aspect of the present invention, a method for controlling image forming conditions in a color image forming apparatus comprising developing devices for forming toner images with developers comprising toner and carriers, a voltage applying section for applying a developing bias voltage for the formation of the toner images, and a toner image bearing member, said method comprising: a step of temporarily keeping the toner images on the toner image bearing member; a step of detecting toner adherence amounts of the toner images formed by the respective developing devices; a step of detecting toner concentrations of the developers in the respective developing devices; a step of calculating, with respect to the respective developing devices, individual optimal developing bias voltage ranges within which a target toner adherence amount can be achieved while the toner concentrations of the developers in the developing devices are within a predetermined toner concentration range from a lower limit to an upper limit, so as to specify a common optimal developing bias voltage range suitable for all the developing devices to achieve the target toner adherence amount while the toner concentrations of the developers in the developing devices are within the predetermined toner concentration range; and a step of calculating individual target toner concentrations in the respective developing devices to achieve the target toner adherence amount while a voltage within the common optimal developing bias voltage range is applied to all the developing devices.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

A color image forming apparatus according to an embodiment of the present invention is hereinafter described with reference to the accompanying drawings.

General Structure of the Color Image Forming Apparatus; See FIG. 1

Figure 1:
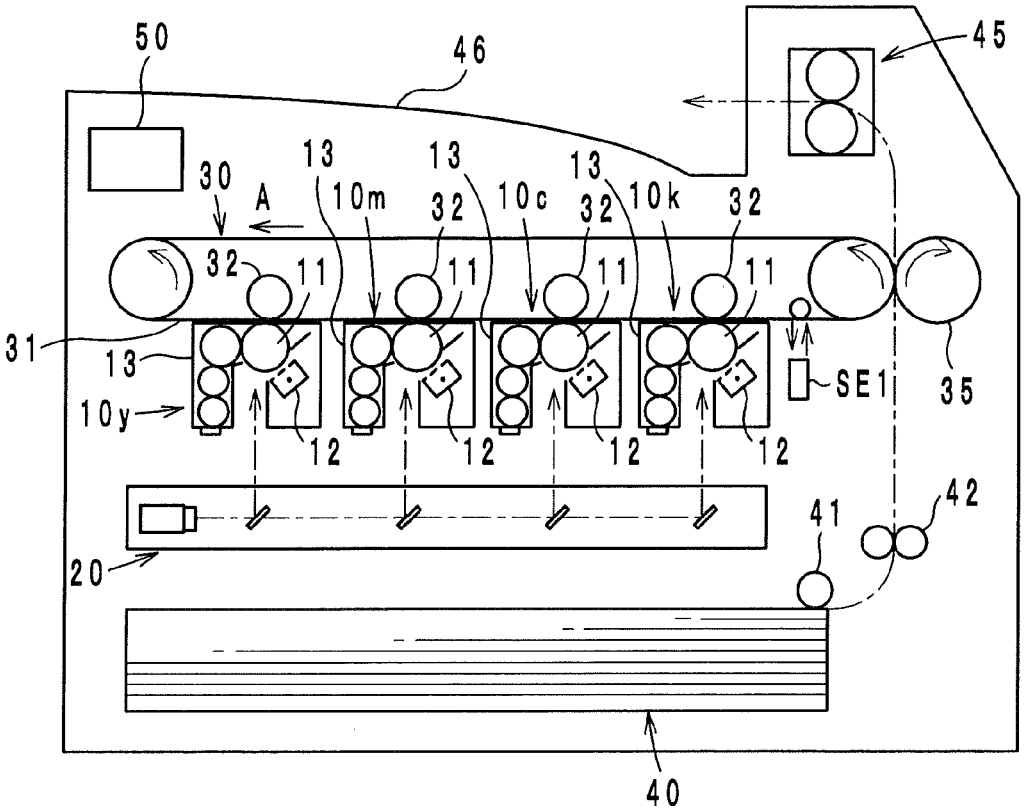
FIG. 1 is a skeleton framework of a color image forming apparatus according to an embodiment of the present invention.

A color image forming apparatus according to an embodiment of the present invention is, as shown by FIG. 1, a tandem type electrophotographic printer. The printer generally comprises image process units 10 (10*y*, 10*m*, 10*c* and 10*k*) for forming toner images of Y (yellow), M (magenta), C (cyan) and K (black), respectively, a laser scanning unit 20 and an intermediate transfer unit 30.

Each of the process units 10 comprises a photosensitive drum 11, a charger 12, a developing device 13, etc. An electrostatic latent image is formed on each of the photosensitive drums 11 by laser radiation from the laser scanning unit 20, and the electrostatic latent image is developed into a toner image by the developing device 13. The intermediate transfer unit 30 has an intermediate transfer belt 31 that is an endless belt driven to rotate in a direction "A". Transfer chargers 32 are disposed to face to the respective photosensitive drums 11, and toner images formed on the photosensitive drums 11 are transferred onto the intermediate transfer belt 31 by electric fields generated by the transfer chargers 32 (first transfer), such that the toner images are combined into a composite full-color image on the intermediate transfer belt 31. Such an electrophotographic image forming process is well known, and a detailed description thereof is omitted.

In a lower part of the body of the image forming apparatus, a sheet feed unit 40 for feeding recording sheets one by one is disposed. Each recording sheet is fed from a feed-out roller 41 to a nip portion between the intermediate transfer belt 31 and a second transfer roller 35, where the composite full-color image is transferred onto the recording sheet (second transfer). Thereafter, the recording sheet is fed to a fixing unit 45, where toner is fixed on the sheet by heat, and the sheet is ejected onto a tray 46 disposed on an upper surface of the apparatus body.

An optical sensor SE1 is disposed downstream from the process unit 10*k* to detect the toner adherence amount on the intermediate transfer belt 31. When the power is switched on or when image formation is carried out on a predetermined number of sheets, image stabilization control is carried out. In the image stabilization control, test toner patterns of a specified type are formed by the process units 10 under specified conditions, and the test toner patterns are transferred onto the intermediate transfer belt 31. Then, the toner adherence amounts of the test toner patterns are detected by the sensor SE1, and in accordance with the detection results, the developing bias voltages for developments of the respective colors are adjusted to achieve the target toner adherence amounts of the colors. The image stabilization control will be described in more detail later.

Developing Device; See FIG. 2

Figure 2:
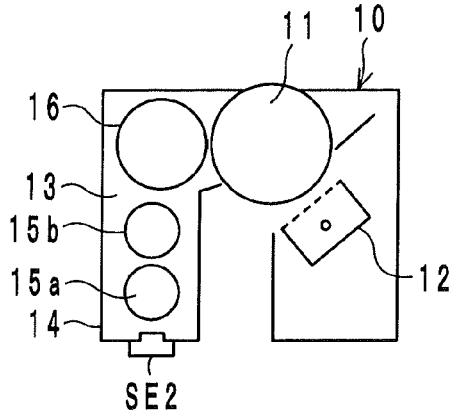
FIG. 2 is a skeleton framework of an image process unit.

The developing devices 13 provided for the process units 10 are of a type using a binary component developer composed of toner and carriers. As shown in FIG. 2, in each of the developing devices 13, a developer is stored in a developer tank 14, and the developer is supplied to a development roller 16, which is disposed to face to the photosensitive drum 11, by developer feed rollers 15*a* and 15*b*. By applying a developing bias voltage between the development roller 16 and the photosensitive drum 11, the developer is supplied from the development roller 16 to the photosensitive drum 11. The photosensitive drum 11 is, for example, charged negative, and negatively charged toner sticks to the photosensitive drum 11 due to a potential difference between the surface potential of the photosensitive drum 11 and the potential of the developing bias.

A magnetic sensor SE2 is disposed on the bottom surface of the developer tank 14 of each of the developing devices 13 to detect the toner concentration in the developer (the mixing ratio of toner to carriers in the developer) at all times. Toner is stored in a refill bottle (not shown), and in accordance with detection result of the sensor SE2, toner is supplied into the developer tank 14 to compensate consumption of toner.

Image Stabilization Control

As shown by FIG. 1, the image forming apparatus comprises a control section 50. The control section 50 is to control the process units 10, and more specifically is to adjust the developing bias voltage, the toner concentration, etc.

A test pattern for the image stabilization control comprises a solid portion, a gradation portion and a background. In the solid portion, the toner adherence amount depends on the potential difference between the electrostatic latent image formed with laser radiation and the DC component of the developing bias voltage, and also depends on the charge amount of toner. Based on a detection result of the solid pattern outputted from the sensor SE1, the developing bias voltage is adjusted so as to achieve a target toner adherence amount. The gradation portion is used for a gamma correction. While the developing bias voltage is fixed to the same value as used for formation of the solid pattern, the area subjected to a specified amount of exposure or the exposure amount is varied, and thereby, the gradation pattern is formed. The sensor SE1 detects the gradation portion, and based on the detection result, a gamma correction is made. The background is a portion that is not subjected to exposure. By controlling the output of the charger 12 such that a specified potential difference between the background and the developing bias voltage is made, toner does not adhere to the background. Further, if the developing bias voltage has an AC component, in the toner adherence control while detecting the solid portion, the amplitude, the duty rate or the like of the AC component of the developing bias voltage may be adjusted. Also, two or more factors of the amplitude, the duty rate, etc. of the DC component, and the amplitude, the duty rate, etc. of the AC component of the developing bias voltage may be adjusted to achieve a target toner adherence amount.

The charge amount of toner is different from color to color, that is, the toners of different colors contained in the developing devices 13 are charged differently from one another. Therefore, in order to achieve the same toner adherence amount on solid portions of the different colors, different developing bias voltages must be applied in the respective process units 10. In this embodiment, it is intended to equalize the charge amounts of toners of all the colors, which are intrinsically different from one another. For this purpose, the target toner concentrations in the developing devices 13 to be achieved by adjustments based on detection results of the toner concentration sensors SE2 are varied, and considering the individual optimal developing bias voltages in the developing devices 13 and a predetermined range of the toner concentrations in the developing devices 13, a common optimal developing bias voltage that is suited for all the developing devices 13 is figured out.

Figure 3A:
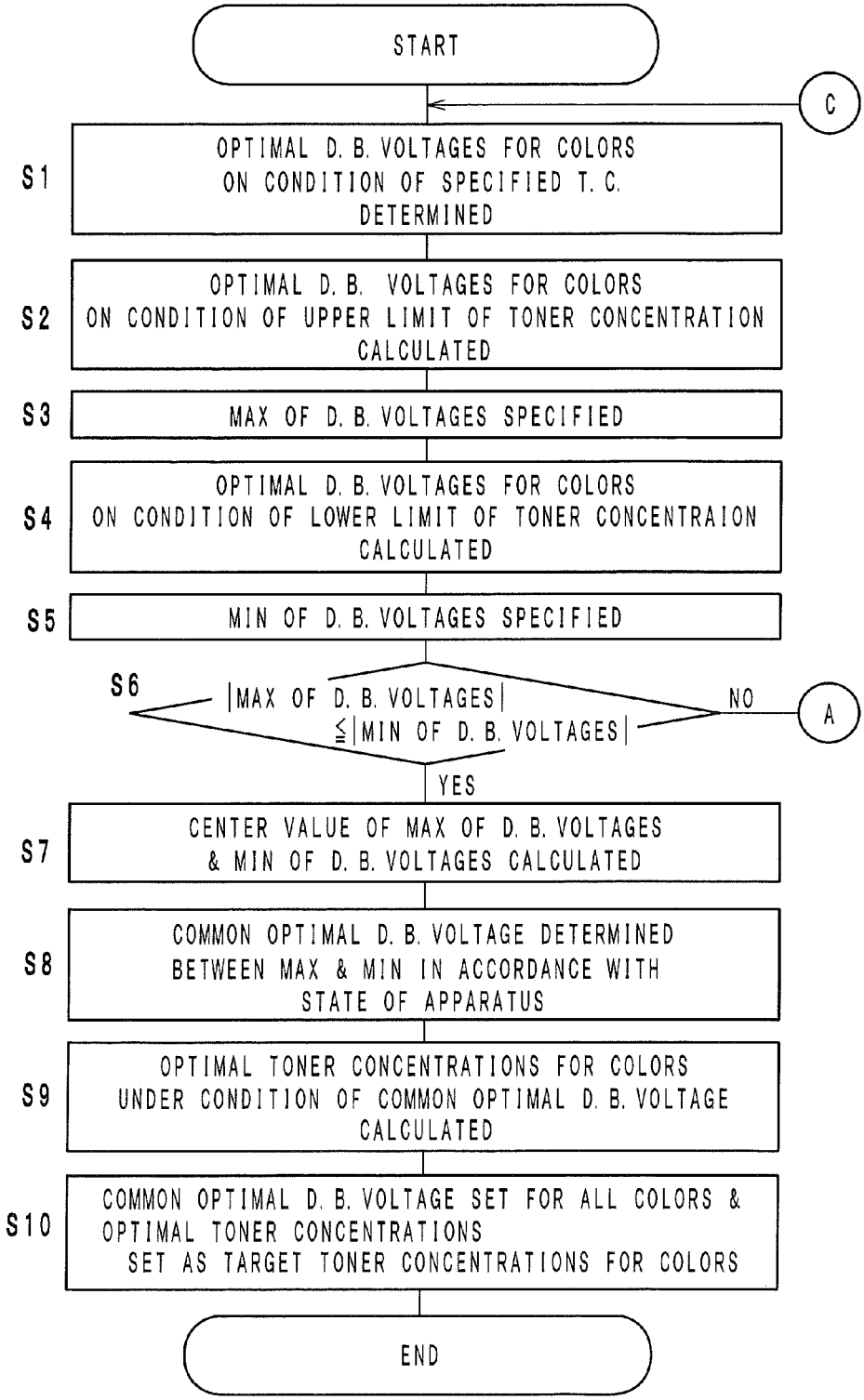
FIGS. 3*a*, 3*b* and 3*c* are flowcharts showing a control procedure for determining a common optimal developing bias voltage and individual target toner concentrations for different colors.
Figure 3B:
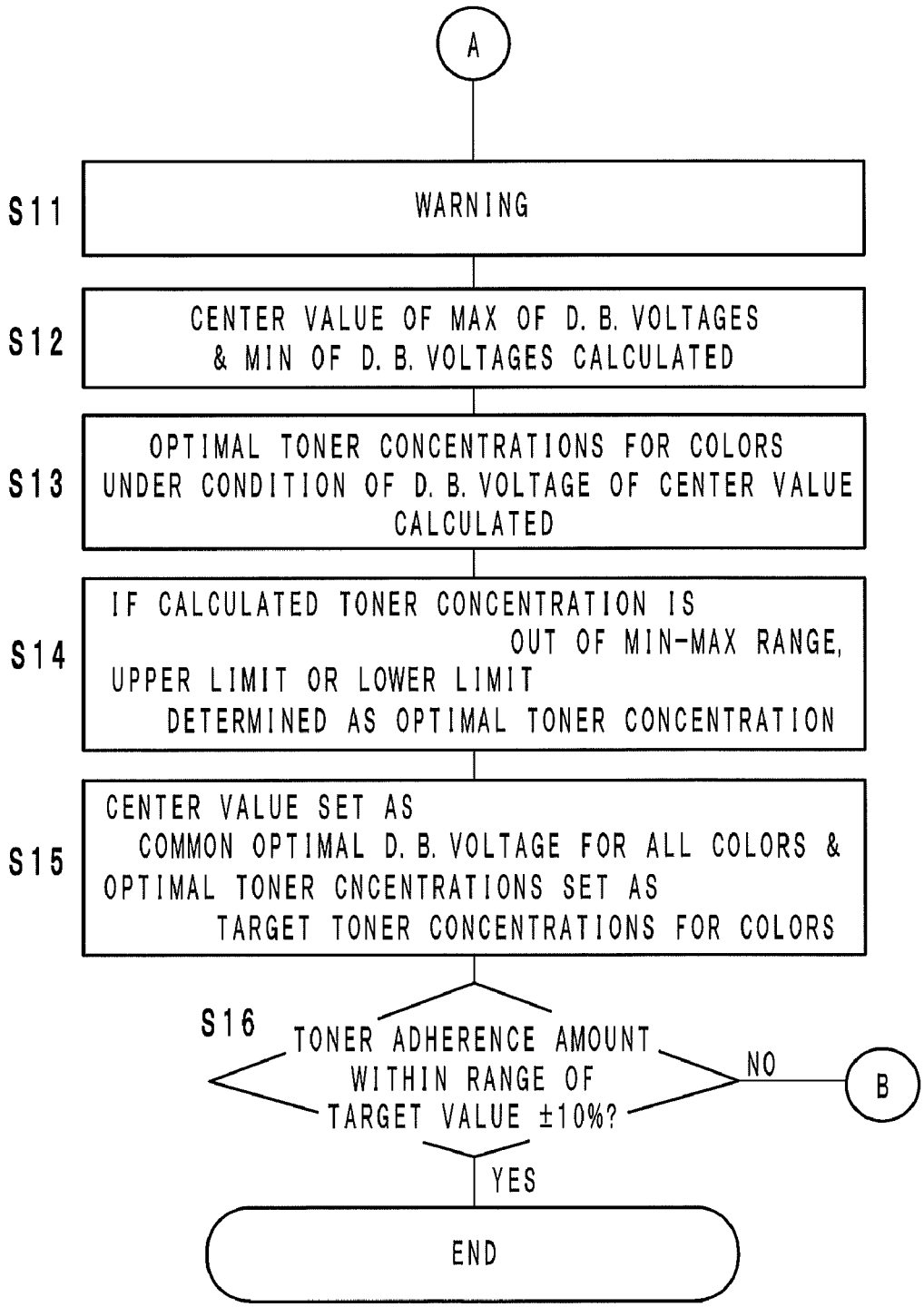
Figure 3C:
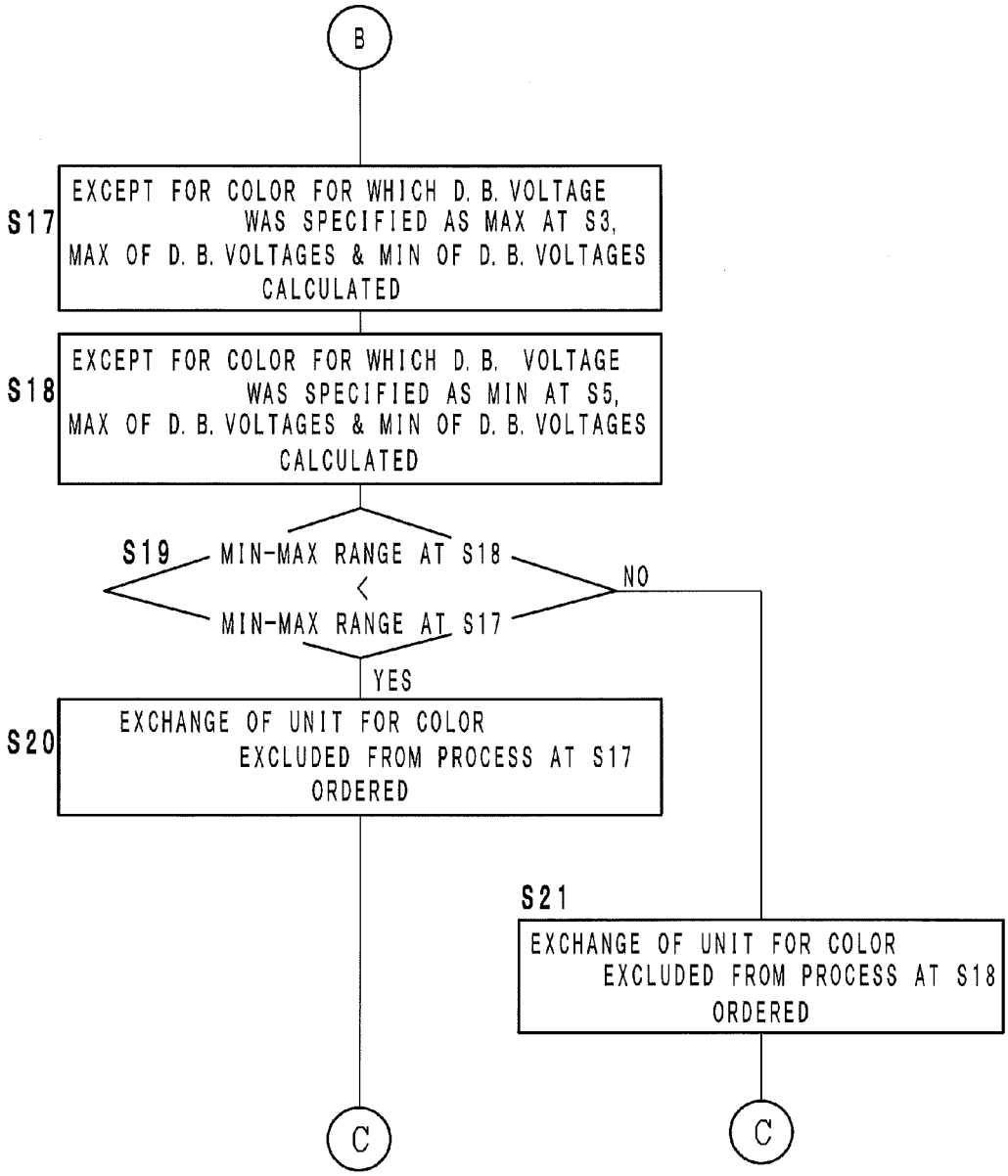

This control is described below, giving a first example and a second example. In the first and the second examples, toners are charged negative. The DC component of the developing bias voltage is denoted by Vdc (−V), and the toner concentration is denoted by Tc (%). FIGS. 3*a*, 3*b* and 3*c* show a procedure for the control.

First Example

In the respective developing devices 13, wherein the toner concentrations Tc are initially 7%, image stabilization control is carried out to determine individual optimal developing bias voltages Vdc to achieve a target toner adherence amount (step 1). Table 1 below shows the individual optimal developing bias voltages Vdc determined for the colors when the toner concentrations Tc in all the developing devices 13 are 7%. In the following tables and in the following paragraphs, "Y", "M", "C" and "K" show the developing devices 13 for the colors, Y, M, C and K, respectively.

TABLE 1

| | Vdc (−V) |
|---|---|
| Y | 300 |
| M | 600 |
| C | 400 |
| K | 500 |

In each of the developing devices 13, the upper limit and the lower limit of the toner concentration Tc are determined to be 5.5% and 8.5%, respectively. A characteristic line showing the relationship between the optimal toner concentration Tc and the optimal developing bias voltage Vdc to achieve a target toner adherence amount is provided for each of the colors. By using the slopes of the characteristic lines of the respective colors, individual optimal developing bias voltages Vdc for the respective colors to achieve the target toner adherence amount when the toner concentrations Tc in all the developing devices 13 are the upper limit are calculated (step 2). Then, from the individual optimal developing bias voltages Vdc for the respective colors under the condition that the toner concentrations Tc are the upper limit, the greatest value is selected (step S3). In the same way, individual optimal developing bias voltages Vdc for the respective colors to achieve the target toner adherence amount when the toner concentrations Tc in all the developing devices 13 are the lower limit are calculated (step 4). From the individual optimal developing bias voltages Vdc for the respective colors under the condition that the toner concentrations Tc in all the developing devices 13 are the lower limit, the smallest value is selected (step S5).

Table 2 shows the thus calculated individual optimal developing bias voltages Vdc for the respective colors under the condition that the toner concentrations Tc in the developing devices 13 are the upper limit and those under the condition that the toner concentrations Tc in the developing devices 13 are the lower limit.

TABLE 2

| | Slope of Characteristic Line (−V/%) | Vdc under Condition of Upper Limit of Tc (−V) | Vdc under Condition of Lower Limit of Tc (−V) |
|---|---|---|---|
| Y | −133 | 101 | 500 |
| M | −167 | 350 | 851 |
| C | −120 | 220 | 580 |
| K | −180 | 230 | 770 |

By exemplifying the color Y, a process of calculating the optimal developing bias voltage Vdc under the condition that the toner concentration Tc is the upper limit is described. As shown in Table 1, when the toner concentration Tc is 7%, the optimal developing bias voltage Vdc for the color Y to achieve the target toner adherence amount is 300 (−V), and the slope of the characteristic line of the color Y is −133. Accordingly, the optimal developing bias voltage for the color Y when the toner concentration Tc is the upper limit (8.5%) is calculated as follows.

$$300-133\times(8.5-7.0)=101\ (-V)$$

Likewise, the optimal developing bias voltages Vdc for the other colors M, C and K when the toner concentrations Tc are the upper limit (8.5%) are calculated as follows.

for the color *M*, $600-167\times(8.5-7.0)=350\ (-V)$ for the color *C*, $400-120\times(8.5-7.0)=220\ (-V)$ for the color *K*, $500-180\times(8.5-7.0)=230\ (-V)$ Among these values calculated as the optimal developing bias voltages Vdc for the four colors under the condition that the toner concentrations Tc are the upper limit, the greatest value is 350 (−V) for the color M.

The optimal developing bias voltages Vdc for the respective colors Y, M, C and K when the toner concentrations Tc are the lower limit can be calculated in the same way, and the following values are obtained.

for the color *Y*, 300−133×(5.5−7.0)=500 (−V)

for the color *M*, 600−167×(5.5−7.0)=851 (−V)

for the color *C*, 400−120×(5.5−7.0)=580 (−V)

for the color *K*, 500−180×(5.5−7.0)=770 (−V)

Among these values calculated as the optimal developing bias voltages Vdc for the four colors under the condition that the toner concentrations Tc are the lower limit, the smallest value is 500 (−V) for the color Y.

From the calculation results, it is found out that as the toner concentrations Tc in the developing devices 13 vary within the predetermined range (between the upper limit and the lower limit), the optimal developing bias voltages Vdc for the colors Y, M, C and K range in the following way:

- the optimal developing bias voltage Vdc for the color Y ranges from 101 to 500 (−V);
- the optimal developing bias voltage Vdc for the color M ranges from 350 to 851 (−V);
- the optimal developing bias voltage Vdc for the color C ranges from 220 to 580 (−V); and
- the optimal developing bias voltage Vdc for the color K ranges from 230 to 770 (−V).

Figure 4:
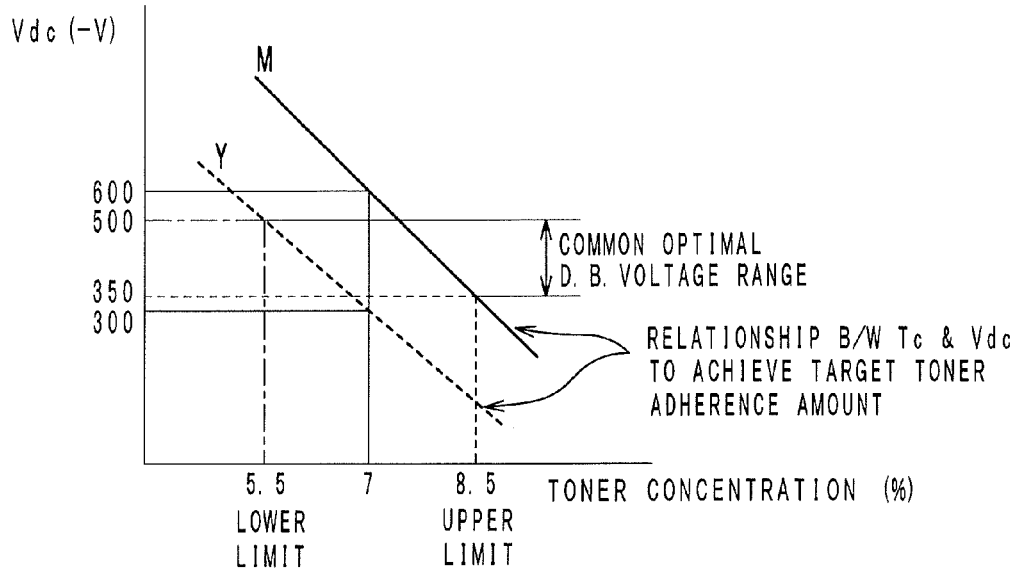
FIG. 4 is a graph showing the relationship between the optimal toner concentration and the optimal developing bias voltage to achieve a target toner adherence amount for the color Y and the relationship between the optimal toner concentration and the optimal developing bias voltage for the color M in a first example.

Judging from the value 350 (−V) that is the greatest value of the individual optimal developing bias voltages Vdc for the respective colors under the condition that the toner concentrations Tc are the upper limit, and the value 500 (−V) that is the smallest value of the individual optimal developing bias voltages Vdc for the respective colors under the condition that the toner concentration Tc is the lower limit (step S6), while the toner concentrations Tc in the developing devices 13 are between the upper limit and the lower limit, it is possible to select a value as a common optimal developing bias voltage that is suited for all the four colors. In this example, the value shall be selected within a range from 350 to 500 (−V). FIG. 4 shows the relationship between the optimal toner concentration Tc and the optimal developing bias voltage Vdc for the color Y and the relationship between the optimal toner concentration Tc and the optimal developing bias voltage Vdc for the color M in this first example. As is apparent from FIG. 4, there is a voltage range within which a value can be selected as the common optimal developing bias voltage Vdc suitable for all the colors.

In this example, a voltage that is suited for developments of all the colors is within a range from 350 to 500 (−V), and the center value of the range is calculated to be 425 (−V) (step S7). Thereafter, the common optimal developing bias voltage Vdc is determined to be the center value or a value around the center value (step S8). More specifically, according to the state of the apparatus, such as the temperature, the humidity and other environmental conditions of the apparatus, and/or the total operation hours of the apparatus, the common optimal developing bias voltage Vdc may be shifted from the center value as long as it is within the range from 350 to 500 (−V). For example, under high humidity, the charge amount of toner becomes lower, and therefore, the common optimal developing bias voltage Vdc may be set to a value within a range from 425 to 500 (−V).

Next, with respect to the respective colors, individual optimal toner concentrations Tc when the developing bias voltages Vdc for all the colors are set to the common optimal value are calculated from the slopes of the characteristic lines, each showing the relationship between the optimal developing bias voltage Vdc and the optimal toner concentration Tc (step S9). For example, the optimal toner concentration Tc for the color Y is calculated in the following way. The optimal developing bias voltage Vdc for the color Y to achieve the target toner adherence amount under the condition that the toner concentration Tc is 7% is 300 (−V) (see Table 1), and the slope of the characteristic line is −133. Therefore, when the developing bias voltage Vdc for the color Y is set to 425 (−V), the optimal toner concentration for the color Y is calculated as follows.

7+{(425−300)/(−133)}=6.1(%)

Likewise, with respect to the other colors M, C and K, optimal toner concentrations Tc when the developing bias voltages Vdc for al the colors are set to the common optimal value 425 (−V) can be calculated as follows.

for the color *M*, 7+{(425−600)/(−167)}=8.1(%)

for the color C, 7+{(425−400)/(−120)}=6.8(%)

for the color K, 7+{(425−500)/(−180)}=7.4(%)

These calculated values are determined to be the target toner concentrations Tc for the respective colors, and the developing bias voltages for the respective colors are set to the common optimal value of 425 (−V) (step S10). In this way, the target toner adherence amount can be achieved at all times although the developing bias voltages Vdc for all the colors are set to one value. Then, only a single power source is necessary to supply a developing bias voltage for developments of all the colors, and only a single power source is necessary to supply a transfer voltage for transfers of all the colors. Thereby, the cost can be reduced.

Second Example

Like in the case of the first example, in the developing devices 13, wherein the toner concentrations Tc are initially 7%, image stabilization control is carried out to determine individual optimal developing bias voltages Vdc to achieve a target toner adherence amount (step 1). Table 3 below shows the individual optimal developing bias voltages Vdc determined for the respective colors when the toner concentrations Tc in all the developing devices 13 are 7%.

TABLE 3

| | Vdc (−V) |
|---|---|
| Y | 300 |
| M | 600 |
| C | 200 |
| K | 700 |

In each of the developing devices 13, the upper limit and the lower limit of the toner concentration Tc are predetermined to be 5.5% and 8.5%, respectively. A characteristic line showing the relationship between the optimal toner concentration Tc and the optimal developing bias voltage Vdc to achieve a target toner adherence amount is provided for each of the colors. By using the slopes of the characteristic lines of the respective colors, individual optimal developing bias voltages Vdc for the respective colors to achieve the target toner adherence amount when the toner concentrations Tc in all the developing devices 13 are the upper limit are calculated (step 2). Then, from the individual optimal developing bias voltages Vdc for the respective colors under the condition that the toner concentrations Tc are the upper limit, the greatest value is selected (step S3). In the same way, individual optimal developing bias voltages Vdc for the respective colors to achieve the target toner adherence amount when the toner concentrations Tc in all the developing devices 13 are the lower limit are calculated (step 4). From the individual optimal developing bias voltages Vdc for the respective colors under the condition that the toner concentrations Tc in all the developing devices 13 are the lower limit, the smallest value is selected (step S5).

Table 4 shows the thus calculated individual optimal developing bias voltages Vdc for the respective colors under the condition that the toner concentrations Tc in the developing devices 13 are the upper limit and those under the condition that the toner concentrations Tc in the developing devices 13 are the lower limit.

TABLE 4

| | Slope of Characteristic Line (−V/%) | Vdc under Condition of Upper Limit of Tc (−V) | Vdc under Condition of Upper Limit of Tc (−V) |
|---|---|---|---|
| Y | −133 | 101 | 500 |
| M | −167 | 350 | 851 |
| C | −120 | 20 | 380 |
| K | −180 | 430 | 970 |

By exemplifying the color Y, a process of calculating the optimal developing bias voltage Vdc under the condition that the toner concentration Tc is the upper limit is described. As shown in Table 1, when the toner concentration Tc is 7%, the optimal developing bias voltage Vdc for the color Y to achieve the target toner adherence amount is 300 (−V), and the slope of the characteristic line of the color Y is −133. Accordingly, the optimal developing bias voltage for the color Y when the toner concentration Tc is the upper limit (8.5%) is calculated as follows.

$$300-133\times(8.5-7.0)=101\ (-V)$$

Likewise, the optimal developing bias voltages Vdc for the other colors M, C and K when the toner concentrations Tc are the upper limit (8.5%) are calculated as follows.

for the color *M*, $600-167\times(8.5-7.0)=350\ (-V)$ for the color *C*, $200-120\times(8.5-7.0)=20\ (-V)$ for the color *K*, $700-180\times(8.5-7.0)=430\ (-V)$ Among these values calculated as the optimal developing bias voltages Vdc for the four colors under the condition that the toner concentrations Tc are the upper limit, the greatest value is 430 (−V) for the color K.

The optimal developing bias voltages Vdc for the colors Y, M, C and K when the toner concentrations Tc are the lower limit can be calculated in the same way, and the following values are obtained.

for the color *Y*, $300-133\times(5.5-7.0)=500\ (-V)$ for the color *M*, $600-167\times(5.5-7.0)=851\ (-V)$ for the color *C*, $200-120\times(5.5-7.0)=380\ (-V)$ for the color *K*, $700-180\times(5.5-7.0)=970\ (-V)$ Among these values calculated as the optimal developing bias voltages Vdc for the four colors under the condition that the toner concentrations Tc are the lower limit, the smallest value is 380 (−V) for the color C.

From the calculation results, it is found out that as the toner concentrations Tc in the developing devices 13 vary within the predetermined range (between the upper limit and the lower limit), the optimal developing bias voltages Vdc for the colors Y, M, C and K range in the following way:

the optimal developing bias voltage Vdc for the color Y ranges from 101 to 500 (−V);

the optimal developing bias voltage Vdc for the color M ranges from 350 to 851 (−V);

the optimal developing bias voltage Vdc for the color C ranges from 20 to 380 (−V); and the optimal developing bias voltage Vdc for the color K ranges from 430 to 970 (−V).

Judging from the value 430 (−V) that is the greatest value of the optimal developing bias voltages Vdc for the respective colors under the condition that the toner concentrations Tc are the upper limit, and the value 380 (−V) that is the smallest value of the optimal developing bias voltages Vdc for the respective colors under the condition that toner concentrations Tc are the lower limit (step S6), while the toner concentration Tc is between the upper limit and the lower limit, it is impossible to select a value as a common optimal developing bias voltage that is suited for all the four colors. Then, the control section 50 sends a warning to an upper controller (step S11).

Figure 5:
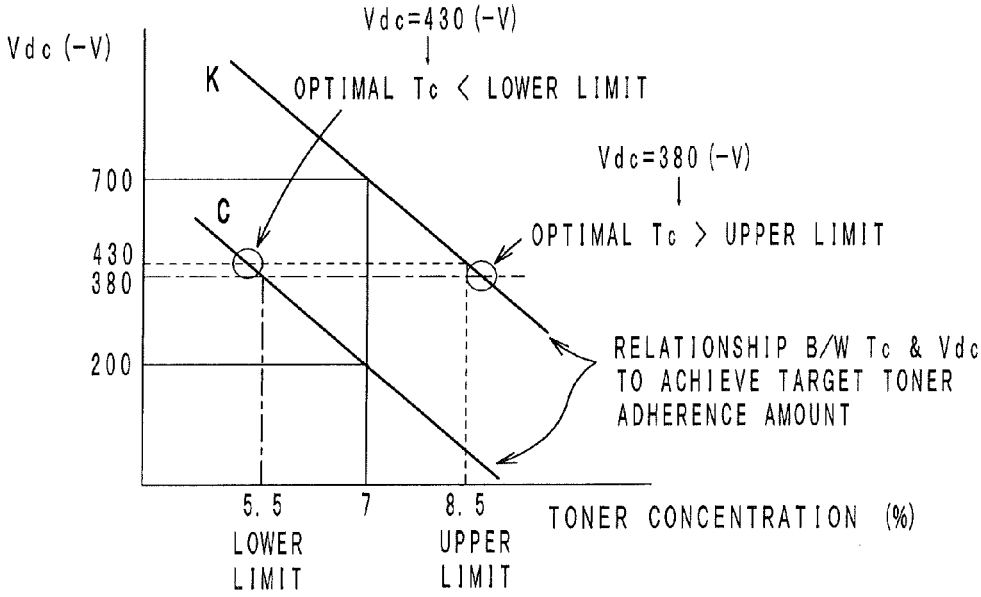
FIG. 5 is a graph showing the relationship between the optimal toner concentration and the optimal developing bias voltage for the color C and the relationship between the optimal toner concentration and the optimal developing bias voltage K in a second example.

FIG. 5 shows the relationship between the optimal toner concentration Tc and the optimal developing bias voltage for the color C and the relationship between the optimal toner concentration Tc and the optimal developing bias voltage for the color K in this second example. In this example, the developing bias voltage of 430 (−V), which is the smallest value of the optimal developing voltages for the respective colors Vdc under the condition that the toner concentrations Tc are the upper limit, is too high for the color C. More specifically, when the developing bias voltage for the color C is set to 430 (−V), even if the toner concentration Tc in the developer C is set to the lower limit, the toner adherence amount of the color C will be beyond the target value. In this case, accordingly, in order to achieve the target toner adherence amount of the color C, the toner concentration Tc in the developer C must be set under the lower limit. On the other hand, the developing bias voltage of 380 (−V), which is the greatest value of the optimal developing voltages for the respective colors under the condition that the toner concentration Tc are the lower limit, is too low for the color K. More specifically, when the developing bias voltage Vdc for the color K is set to 380 (−V), even if the toner concentration Tc in the developer K is set to the upper limit, the toner adherence amount of the color K will be under the target value. In this case, accordingly, in order to achieve the target toner adherence amount of the color K, the toner concentration Tc in the developer K must be set beyond the upper limit.

Next, the center value between the greatest value of the optimal developing bias voltages Vdc for the respective colors under the condition that the toner concentrations Tc are the upper limit and the smallest value of the optimal developing bias voltages Vdc for the respective colors under the condition that the toner concentrations Tc are the lower limit is calculated. In the second example, the center value between 430 (−V) and 380 (−V) is calculated to be 405 (−V) (step S12).

The center value calculated at step S12 is determined as the common optimal developing bias voltage Vdc suitable for all the colors. Next, with respect to the respective colors, individual optimal toner concentrations Tc when the developing bias voltages Vdc for all the colors are set to the center value are calculated from the slopes of the characteristic lines, each showing the relationship between the optimal developing bias voltage Vdc and the optimal toner concentration Tc (step S13). For example, the optimal toner concentration Tc for the color Y is calculated in the following way. The optimal developing bias voltage Vdc for the color Y to achieve the target toner adherence amount under the condition that the toner concentration Tc is 7% is 300 (−V) (see Table 1), and the slope of the characteristic line for the color Y is −133. Therefore, when the developing bias voltage Vdc for the color Y is set to 405 (−V), the optimal toner concentration Tc for the color Y is calculated as follows.

$$7+\{(405-300)/(-133)\}=6.2(\%)$$

Likewise, with respect to the other colors M, C and K, the optimal toner concentrations Tc when the developing bias voltages Vdc for the colors M, C and K are set to 405 (−V) can be calculated as follows.

for the color *M*, $7+\{(405-600)/(-167)\}=8.2(\%)$ for the color *C*, $7+\{(405-400)/(-120)\}=5.3(\%)$ for the color *K*, $7+\{(405-500)/(-180)\}=8.6(\%)$ In this case, the optimal toner concentration Tc calculated for the color C is under the lower limit (5.5%), and the optimal toner concentration Tc calculated for the color K is beyond the upper limit (8.5%). Then, the target toner concentration Tc for the color C is determined to be the lower limit value (5.5%), and the target toner concentration Tc for the color K (step S14) is determined to be the upper limit value (8.5%). The target toner concentrations Tc for the colors Y and M are determined respectively to be the calculated values. Then, the developing bias voltages Vdc for all the colors are set to the value 405 (−V) (step S15).

Next, in order to certify whether the developing devices 13 of the colors, for which the target toner concentrations Tc were determined to be the lower limit value and the upper limit value respectively, can achieve the target toner adherence amount, test patterns are detected with the sensor SE1 (step S16). When the detection results are within the range of ±10% of the target toner adherence amount, it is judged that normal image formation is possible, and this control procedure is completed.

On the other hand, if the detection results are beyond the range of ±10% of the target toner adherence amount, the following processes are carried out. First, except for the color for which optimal developing bias voltage Vdc is judged to be the greatest at step S3 of all the individual optimal developing bias voltages Vdc under the condition that the toner concentrations Tc are the upper limit, the individual optimal developing bias voltages Vdc calculated at step S2 are compared. Thereby, the greatest value of the individual optimal developing bias voltages Vdc for the three colors under the condition that the toner concentrations Tc are the upper limit and the smallest value of the individual optimal developing bias voltages Vdc for the three colors under the condition that the toner concentrations Tc are the lower limit are specified (step S17). Next, except for the color for which optimal developing bias voltage Vdc is judged to be the smallest at step S5 of all the individual optimal developing bias voltages Vdc under the condition that the toner concentrations Tc are the lower limit, the optimal developing bias voltages Vdc calculated at step S4 are compared. Thereby, the greatest value of the optimal developing bias voltages Vdc for the three colors under the condition that the toner concentrations Tc are the upper limit and the smallest value of the optimal developing bias voltages Vdc for the three colors under the condition that the toner concentrations Tc are the lower limit are specified (step S18).

Next, the greatest value and the smallest value specified at step S17 are compared with each other, and the greatest value and the smallest value specified at step S18 are compared with each other. Then, when the difference between the greatest value and the smallest value specified at step S17 is larger than the difference between the greatest value and the smallest value specified at step S18, an order to exchange the image process unit 10 for the color that was excluded from the process at step S17 is made (step S20). When the difference between the greatest value and the smallest value specified at step S18 is larger than the difference between the greatest value and the smallest value specified at step S17, an order to exchange the image process unit 10 for the color excluded from the process at step S18 is made (step S21). After the exchange of the image process unit 10, the proceeding returns to step S11, so that the common optimal developing bias voltage Vdc to be applied to all the developing devices 13 and the individual target toner concentrations Tc in all the developing devices 13 are calculated again.

In the second example, the processes from step S17 to step S21 are carried out in the following way. Since it is judged at step S3 that the value 430 (−V) for the color K is the greatest value of the individual optimal developing bias voltages Vdc for the four colors under the condition that the toner concentrations Tc are the upper limit, the values for the color K calculated at step S2 are excluded from the process at step S17. Therefore, at step S17, the greatest value of the optimal developing bias voltages Vdc for the other three colors Y, M and C under the condition that the toner concentrations Tc are the upper limit is judged to be 350 (−V), and the smallest value of the optimal developing bias voltages Vdc for the three colors Y, M and C under the condition that the toner concentrations Tc are the lower limit is judged to be 380 (−V). Then, the difference between these values are 30 (−V). Next, since it is judged at step S6 that the value 380 (−V) for the color C is the smallest value of the individual optimal developing bias voltages Vdc for the four colors under the condition that the toner concentration Tc are the upper limit, the values for the color C calculated at step S2 are excluded from the process at step S18. Therefore, at step S18, the greatest value of the optimal developing bias voltages Vdc for the other three colors Y, M and K under the condition that the toner concentrations Tc are the upper limit is judged to be 430 (−V), and the smallest value of the optimal developing bias voltages Vdc for the three colors Y, M and K under the condition that the toner concentration Tc are the lower limit is judged to be 500 (−V). Then, the difference between these values are 70 (−V). Thus, the difference between the greatest value and the smallest value when the values for the color C are excluded is 40 (−V) larger than the difference between the greatest value and the smallest value when the values for the color K are excluded. Accordingly, an exchange of the process unit 10 for the color C is ordered.

Other Control Procedures

In the control procedure above, first, under the condition that the toner concentrations Tc in the developing devices 13 are 7%, optimal developing bias voltages Vdc for the respective colors to achieve a target toner adherence amount are determined. Thereafter, based on the values, optimal developing bias voltages Vdc for the respective colors under the condition that the toner concentrations Tc are the upper limit and optimal developing bias voltages Vdc for the respective colors under the condition that the toner concentrations Tc are the lower limit are calculated. However, optimal developing bias voltages Vdc for the respective colors to achieve a target toner adherence amount under the condition that the toner concentrations Tc are the lower limit may be determined first, and based on the values, optimal developing bias voltages Vdc for the respective colors under the condition that the toner concentrations Tc is the upper limit may be calculated, so that a common optimal developing bias voltage suitable for all the colors can be determined. In this case, since the initial toner concentrations Tc in the developing devices 13 are the lower limit, it is necessary to supply only toner so as to adjust the toner concentrations Tc to the respective target values, and thus, speedy adjustments of the toner concentrations Tc are possible. Data about the relationship between the optimal toner concentration Tc and the optimal developing bias voltage Vdc for each of the colors may be stored in a control table. Alternatively, with respect to each of the colors, optimal developing bias voltages to achieve the target toner adherence amount under different toner concentrations Tc may be calculated while toner is supplied to raise the toner concentration Tc gradually from the lower limit of 5.5%, and thereby, the relationship between the toner concentration Tc and the optimal developing bias voltage Vdc can be found out.

Further, the upper limit of toner concentration Tc may be different from color to color. The toner concentration Tc of each color may be judged directly from the row output value of the sensor SE2. In the embodiment above, after making a warning, it is judged whether the toner adherence amount detected by the sensor SE1 is within a range of ±10% from the target value. However, the range is not necessarily ±10% from the target value, and the range may be determined according to the model of the apparatus.

In the control procedure above, the DC component Vdc of the developing bias voltage is used as a factor of the toner adherence amount. It is well known that when the developing bias voltage is composed of a DC component and an AC component, either of the components can be used as a factor of the toner adherence amount. Therefore, the amplitude, the duty ratio or the like of the AC component of the developing bias voltage may be used as a factor of the toner adherence amount.

As mentioned, when binary component developers of different colors are used, charge amounts of toners of different colors, which are intrinsically different from each other, can be adjusted to the same level by adjusting the toner concentrations in the respective developing devices. Also, by clarifying the relationship between the developing bias voltage and the toner adherence amount on the toner image bearing member with respect to each color, the charging characteristic of toner of each color can be recognized. In order to equalize the toner amounts of toners of different colors, with the developing bias voltages to be applied to the developing devices set to the same value and with the target toner adherence amounts of the respective colors set to the same value, the toner concentrations in the respective developing devices shall be adjusted. More specifically, first, individual optimal developing bias voltage ranges for the respective developing devices to achieve the target toner adherence amount while the toner concentrations in the respective developing devices are within a predetermined range are found out, and next, from the individual optimal developing bias voltage ranges, a common optimal developing bias voltage range that is suitable for the all the developing devices to achieve the target toner adherence amount is calculated. Thereafter, individual optimal toner concentrations in the respective developing devices when the developing bias voltages for all the developing devices are set to the common optimal value are calculated, and these calculated values are determined as the target toner concentrations in the respective developing devices.

In the image forming apparatus that carries out the control procedure above, only a single power source is necessary to apply developing bias voltages for developments of all the colors, and only a single power source is necessary to apply transfer voltages for transfers of all the colors. Also, the target toner adherence amount of the colors can be achieved while the toner concentrations in the respective developing devices are kept within a predetermined range.

Although the present invention has been described in connection with the preferred embodiment above, it is to be noted that various changes and modifications are possible to those who are skilled in the art. Such changes and modifications are to be understood as being within the scope of the invention.

What is claimed is:

1. A color image forming apparatus comprising:

photosensitive members;

chargers for charging surfaces of the respective photosensitive members;

an exposure device for forming electrostatic latent images on the surfaces of the photosensitive members charged by the chargers;

developing devices for developing the respective electrostatic latent images into toner images with developers comprising toner and carriers;

toner concentration sensors for detecting toner concentrations of the developers in the respective developing devices;

a voltage applying section for applying a developing bias voltage between each of the photosensitive members and each of the developing devices;

a toner image bearing member for bearing toner images formed by the developing devices temporarily;

a toner adherence amount sensor for detecting toner adherence amounts of the toner images held on the image bearing member; and a controller for calculating, with respect to the developing devices, individual optimal developing bias voltage ranges within which a target toner adherence amount can be achieved while the toner concentrations of the developers are within a predetermined toner concentration range from a lower limit to an upper limit, so as to specify a common optimal developing bias voltage range that are commonly suitable for all the developing devices to achieve the target toner adherence amount while the toner concentrations of the developers in the developing devices are within the predetermined toner concentration range, and for calculating individual target toner concentrations of the developers in the respective developing devices to achieve the target toner adherence amount while a voltage within the common optimal developing bias voltage range is applied between each of the photosensitive members and each of the developing devices.

2. A color image forming apparatus according to claim 1, wherein the controller varies the common optimal developing bias voltage range in accordance with environmental conditions.

3. A color image forming apparatus according to claim 1, wherein the controller varies the common optimal developing bias voltage range in accordance with conditions of the image forming apparatus.

4. A color image forming apparatus according to claim 1, wherein when the controller judges that the common optimal developing bias voltage range does not exist, the controller specifies a first developing device in which a maximum of the optimal developing bias voltage range is smaller than maximums of the individual optimal developing bias voltage ranges in the other developing devices and a second developing device in which a minimum of the optimal developing bias voltage range is greater than minimums of the individual optimal developing bias voltage ranges in the other developing devices, and sets the common optimal developing bias voltage to a mid value of the maximum of the optimal developing bias voltage range in the developing device and the minimum of the optimal developing bias voltage in the second developing device.

5. A color image forming apparatus according to claim 4, wherein the controller further sets the target toner concentration in the first developing device and the target toner concentration in the second developing device to values that are within the predetermined toner concentration range and that are respectively the nearest to optimal toner concentrations to achieve the target toner adherence amount when the mid value is applied as the developing bias voltages in the first and the second developing devices.

6. A color image forming apparatus according to claim 1, wherein when the controller judges that the common optimal developing bias voltage range does not exist, the controller specifies a first developing device in which a maximum of the optimal developing bias voltage range is smaller than maximums of the individual optimal developing bias voltage ranges in the other developing devices and a second developing device in which a minimum of the optimal developing bias voltage range is greater than minimums of the individual optimal developing bias voltage ranges in the other developing devices, and orders an exchange of the first developing device or the second developing device.

7. A method for controlling image forming conditions in a color image forming apparatus comprising developing devices for forming toner images with developers comprising toner and carriers, a voltage applying section for applying a developing bias voltage for the formation of the toner images, and a toner image bearing member, said method comprising:

a step of temporarily keeping the toner images on the toner image bearing member;

a step of detecting toner adherence amounts of the toner images formed by the respective developing devices;

a step of detecting toner concentrations of the developers in the respective developing devices;

a step of calculating, with respect to the respective developing devices, individual optimal developing bias voltage ranges within which a target toner adherence amount can be achieved while the toner concentrations of the developers in the developing devices are within a predetermined toner concentration range from a lower limit to an upper limit, so as to specify a common optimal developing bias voltage range suitable for all the developing devices to achieve the target toner adherence amount while the toner concentrations of the developers in the developing devices are within the predetermined toner concentration range; and a step of calculating individual target toner concentrations in the respective developing devices to achieve the target toner adherence amount while a voltage within the common optimal developing bias voltage range is applied to all the developing devices.

8. A method according to claim 7, further comprising a step of varying the common optimal developing bias voltage range in accordance with environmental conditions.

9. A method according to claim 7, further comprising a step of varying the common optimal developing bias voltage range in accordance with conditions of the image forming apparatus.

10. A method according to claim 7, further comprising:

a step of judging whether the common optimal developing bias voltage range exists;

wherein, when the common optimal developing bias voltage range is judged not to exist, the following steps are carried out:

a step of specifying a first developing device in which a maximum of the optimal developing bias voltage range is smaller than maximums of the individual optimal developing bias voltage ranges in the other developing devices and a second developing device in which a minimum of the optimal developing bias voltage range is greater than the minimums of the individual optimal developing bias voltage ranges in the other developing devices; and a step of setting the common optimal developing bias voltage to a mid value of the maximum of the optimal developing bias voltage range in the first developing device and the minimum of the optimal developing bias voltage range in the second developing device.

11. A method according to claim 10, further comprising a step of setting the target toner concentrations in the first and the second developing devices to values that are within the predetermined toner concentration range and that are respectively the nearest to optimal toner concentrations to achieve the target toner adherence amount while the mid value is applied to the first and the second developing devices.

12. A method according to claim 7, further comprising:

a step of judging whether the common optimal developing bias voltage range exists;

wherein when the common optimal developing bias voltage range is judged not to exist, the following steps are carried out:

a step of specifying a first developing device in which a maximum of the optimal developing bias voltage range is smaller than maximums of the individual optimal developing bias voltage ranges in the other developing devices and a second developing device in which a minimum of the optimal developing bias voltage range is the greater than minimums of the individual optimal developing bias voltage ranges in the other developing devices; and a step of ordering an exchange of the first developing device or the second developing device.

* * * * *